US005139470A

United States Patent [19]

Wang

[11] Patent Number: 5,139,470

[45] Date of Patent: Aug. 18, 1992

[54] EXERCISER HAVING A RESISTANCE ADJUSTMENT MECHANISM

[76] Inventor: Tarrassa Wang, 2nd Fl., No. 20-1, Alley 6, Lane 670, Raya Rd., Taichung, Taiwan

[21] Appl. No.: 820,803

[22] Filed: Jan. 15, 1992

[51] Int. Cl.[5] ..... A63B 22/04; A63B 71/008

[52] U.S. Cl. ..... 482/53; 482/113

[58] Field of Search ..... 482/53, 52, 111, 112, 482/113, 58, 70, 71, 73, 79, 80

[56] References Cited

U.S. PATENT DOCUMENTS 4,496,147 1/1985 DeCloux et al. ..... 482/53

4,681,316 7/1987 DeCloux ..... 482/113

5,004,224 4/1991 Wang .

*Primary Examiner*—Stephen R. Crow

[57] ABSTRACT

An exerciser including a pair of treadles pivotally coupled to the frame body of the exerciser, a column fixed to the front end of each of the treadles and extended downwards, a pair of hydraulic cylinders having one end pivotally coupled to the frame body and having a piston rod coupled to the lower ends of the columns, and a valve coupled between the hydraulic cylinders so as to control the flowing of the hydraulic oil between the hydraulic cylinders so that the resistance of the hydraulic cylinders applied to the treadles can be adjusted.

2 Claims, 3 Drawing Sheets

EXERCISER HAVING A RESISTANCE ADJUSTMENT MECHANISM

BACKGROUND OF THE INVENTION

1. Field of the Invention

The present invention relates to an exerciser, and more particularly to an exerciser having a resistance adjustment mechanism.

2. Description of the Prior Art

The closest prior art of which applicant is aware is his prior U.S. Pat. No. 5,004,224 to Wang, entitled "Stepping Exerciser", filed Jun. 1, 1990. One end of each of the hydraulic cylinders is adjustable up and down along respective rod 41 so that the resistance of the hydraulic cylinders can be adjusted.

The present invention has arisen to provide a novel type of resistance adjustment mechanism for exercising mechanisms.

SUMMARY OF THE INVENTION

The primary objective of the present invention is to provide an exerciser which has a resistance adjustment mechanism for adjusting the resistance of hydraulic cylinders applied to the treadles.

In accordance with one aspect of the invention, there is provided an exerciser including a frame body, a pair of treadles, the front end of the treadles being pivoted to the front end of the frame body, a column fixed to the front end of each of the treadles and extended downwards, a pair of hydraulic cylinders having one end pivotally coupled to the frame body, each of the hydraulic cylinders including a piston slidably disposed therein and including a piston rod fixed to the piston, the other end of the piston rod being extended outwards of the hydraulic cylinders and pivotally coupled to the lower ends of the columns so that the pistons are movable back and forth in the hydraulic cylinders respectively, each of the hydraulic cylinders including a chamber defined between the piston and the second end thereof for containing hydraulic oil, and a valve coupled between the chambers of the hydraulic cylinders so as to control the flowing of the hydraulic oil between the chambers so that the resistance of the hydraulic cylinders applied to the treadles can be adjusted. A motor is coupled to the valve in order to control the valve.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
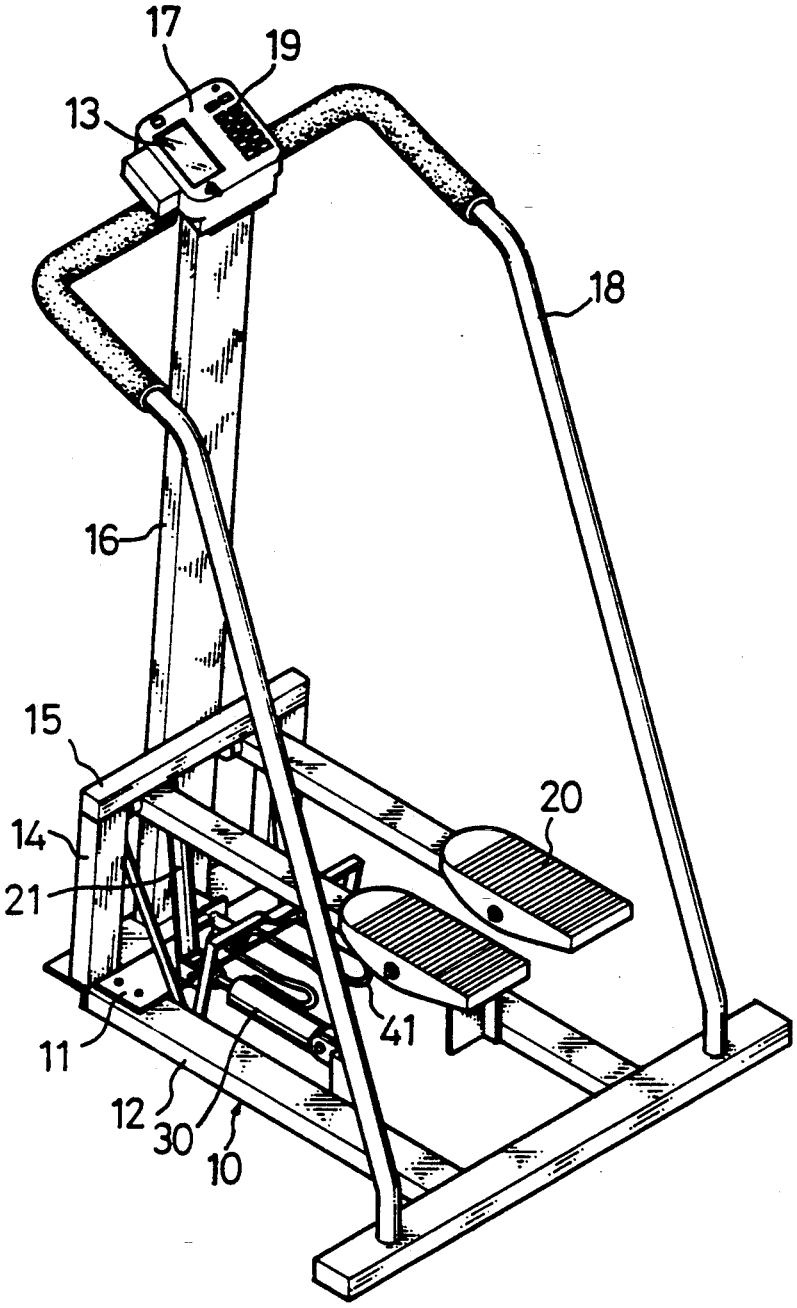
FIG. 1 is a perspective view of an exerciser in accordance with the present invention.
Figure 2:
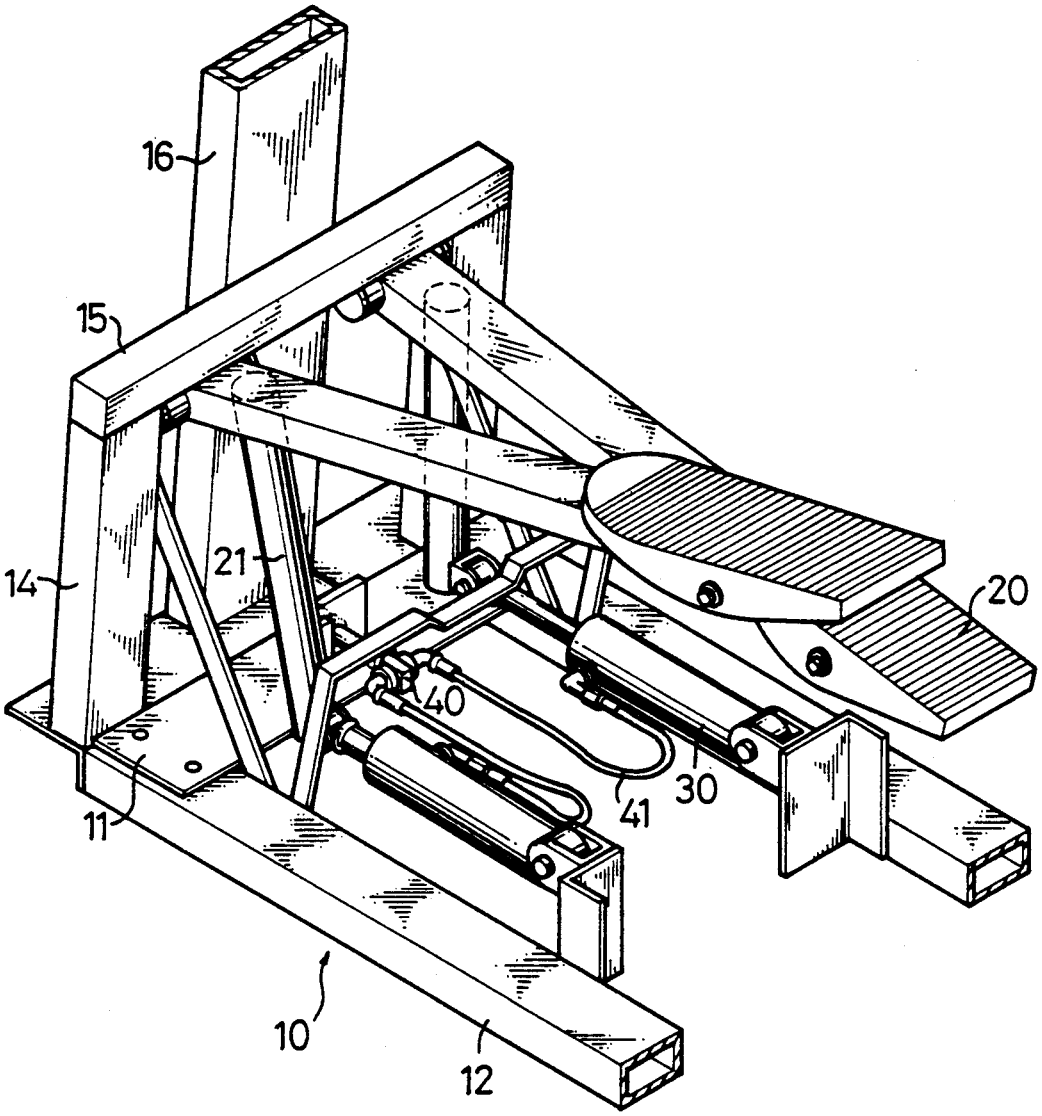
FIG. 2 is a partial perspective view of the exerciser in enlarged scale.
Figure 3:
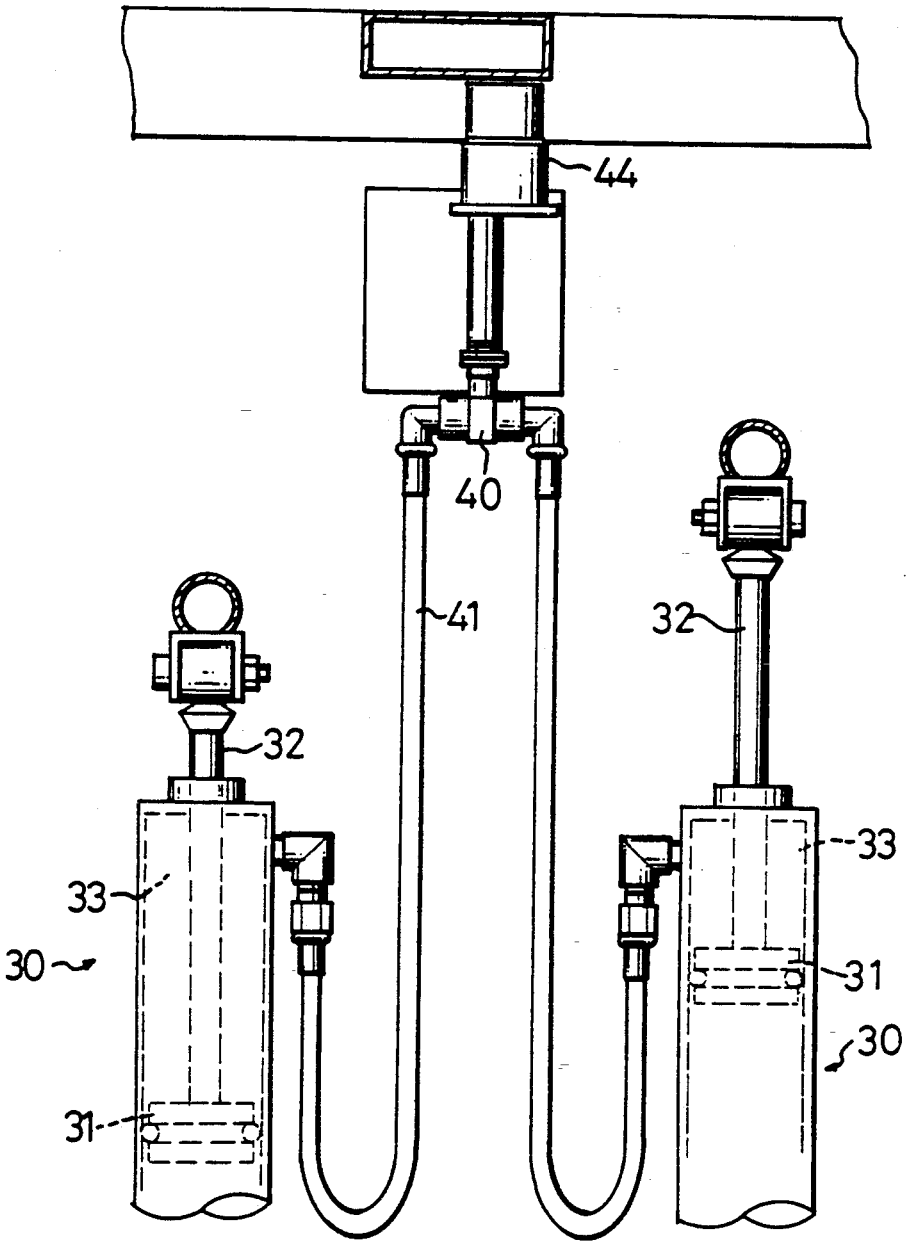
FIG. 3 is a top view of the resistance adjustment mechanism.

Referring to the drawings, an exerciser in accordance with the present invention comprises generally a frame body 10 including a strip 11 laterally disposed between two parallel beams 12, a pair of posts 14 vertically disposed at the front ends of the beams 11, a bar 15 laterally fixed between the top ends of the posts 14, a pole 16 vertically disposed at the front end of the frame body 10 and having a control box 17 disposed on the upper end thereof, and a pair of armrests 18 disposed between the upper end of the pole 16 and the rear and lower end of the frame body 10. A plurality of press buttons 19 and a displayer 13 are provided on the control box 17.

A pair of treadles 20 include a front end pivotally coupled to the bar 15 and a rear end movable up and down. A column 21 has an upper end fixed to the front end of each of the treadles 20 and extends downward from the respective treadle 20, the columns 21 move in concert with the treadles 20 and can be caused to move in a swinging action about the pivot axle of the treadles 20 to the frame body 10.

A pair of hydraulic cylinders 30 each has a first end pivotally coupled to the frame body 10 and each has a piston 31 slidably disposed therein, a piston rod 32 has a first end fixed to each of the pistons 31 and has a second end extended outward of the second end of the respective hydraulic cylinder 30 and fixed to a lower end of a respective column 21 so that the pistons 31 can be caused to move back and forth within the respective hydraulic cylinders 30. It is to be noted that one of the pistons 31 will move towards the first end of the hydraulic cylinder 30 when the other piston 31 moves towards the second end of the hydraulic cylinder 30. A chamber 33 is defined between the second end of each of the hydraulic cylinders 30 and a respective piston 31 and is capable of containing hydraulic oil. A valve 40 is disposed on the strip 11 and is coupled between the second ends of the cylinders 30 by two pipes 41 so that the hydraulic oil can flow from one of the chambers to the other. A motor 44 is coupled to the valve 40 for controlling the valve 40 in order to control the flow rate of the hydraulic oil flowing from one hydraulic cylinder to the other. The motor 44 can be controlled by the press buttons 19 provided on top of the pole 16.

When the valve 40 is fully opened, the hydraulic oil can easily flow from one hydraulic cylinder to the other so that the resistance applied to the treadles 20 is small, however, when the valve 40 is closed, the hydraulic oil is prohibited from flowing between the hydraulic cylinders 30 so that the resistance applied to the treadles 20 is large and so that the users have to spend more energy to simulate stepping or climbing exercise. The valve 40 can be gradually adjusted from closed state to open state.

It is to be noted that the resistance adjustment mechanism can also be applied to other type of exercising mechanism, such as rowing exerciser, which uses hydraulic cylinders to provide resistance to the treadles.

Accordingly, the exerciser in accordance with the present invention includes a resistance adjustment mechanism for adjusting the resistance applied to the treadles thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising a frame body, a pair of treadles each including a front end pivoted to a front end of said frame body, a column fixed to said front end of each of said treadles and extended downwards and including a lower end, a pair of hydraulic cylinders including a first end pivotally coupled to said frame body and including a second end, each of said hydraulic cylinders including a piston slidably disposed therein and including a piston rod having a first end fixed to said piston and having a second end extended outwards of said second end of each of said hydraulic cylinders, said second ends of said piston rod being pivotally coupled to said lower ends of said columns respectively so that said pistons are movable back and forth in said hydraulic cylinders respectively, each of said hydraulic cylinders including a chamber defined between said piston and said second end thereof for containing hydraulic oil, and a valve coupled between said chambers of said hydraulic cylinders so as to control the flowing of the hydraulic oil between said chambers so that the resistance of said hydraulic cylinders applied to said treadles can be adjusted.

2. An exerciser comprising a frame body, a pair of treadles each including a front end pivoted to a front end of said frame body, a column fixed to said front end of each of said treadles and extended downwards and including a lower end, a pair of hydraulic cylinders including a first end pivotally coupled to said frame body and including a second end, each of said hydraulic cylinders including a piston slidably disposed therein and including a piston rod having a first end fixed to said piston and having a second end extended outwards of said second end of each of said hydraulic cylinders, said second ends of said piston rod being pivotally coupled to said lower ends of said columns respectively so that said pistons are movable back and forth in said hydraulic cylinders respectively, each of said hydraulic cylinders including a chamber defined between said piston and said second end thereof for containing hydraulic oil, a valve coupled between said chambers of said hydraulic cylinders so as to control the flowing of the hydraulic oil between said chambers so that the resistance of said hydraulic cylinders applied to said treadles can be adjusted, and a motor coupled to said valve in order to control said valve.

* * * * *